US005307656A

United States Patent [19]

Gartner et al.

[11] Patent Number: 5,307,656

[45] Date of Patent: May 3, 1994

[54] HIGH SECURITY ELECTRONIC DIAL COMBINATION LOCK

[75] Inventors: Klaus W. Gartner, Palos Verdes Estates; Larry I. Cutter, Torrance; Peter J. Phillips, Lake Arrowhead, all of Calif.

[73] Assignee: La Gard, Inc., Torrance, Calif.

[21] Appl. No.: 629,119

[22] Filed: Dec. 17, 1990

[51] Int. Cl.[5] ..... E05B 47/00

[52] U.S. Cl. ..... 70/277; 70/278; 70/303 A; 70/322

[58] Field of Search ..... 70/277, 278, 303 A, 70/301, 302, 303 R, 133, 321, 322

[56] References Cited

U.S. PATENT DOCUMENTS

| | | | |
|---|---|---|---|
| 686,073 | 11/1901 | Hollar et al. | 70/278 |
| 1,353,257 | 9/1920 | Mample | 70/278 |
| 1,867,001 | 7/1932 | Diesel | 70/303 A X |
| 2,079,702 | 5/1937 | Diesel | 70/269 |
| 2,775,114 | 12/1956 | Lee | 70/133 |
| 2,925,726 | 2/1960 | Miller | 70/303 A |
| 3,045,466 | 7/1962 | Herlong | 70/303 |
| 3,339,382 | 9/1967 | Miller et al. | 70/23 |
| 3,376,721 | 4/1968 | Levine | 70/277 |
| 3,559,430 | 2/1971 | Waller | 70/277 |
| 3,702,070 | 11/1972 | Gartner | 70/278 |
| 3,702,551 | 11/1972 | Blizard | 70/269 |
| 3,758,734 | 9/1973 | Gartner | 200/5 R |
| 3,968,667 | 7/1976 | Gartner et al. | 70/303 A |
| 3,980,844 | 9/1976 | Bianco | 200/43 |
| 3,981,167 | 9/1976 | Phillips | 70/311 |
| 3,991,596 | 11/1976 | Gartner | 70/355 X |
| 4,038,846 | 8/1977 | Klann | 70/220 |
| 4,106,316 | 8/1978 | Tippin | 70/268 |
| 4,142,388 | 3/1979 | Phillips et al. | 70/316 |
| 4,148,092 | 4/1979 | Martin | 361/172 |
| 4,328,689 | 5/1982 | Keller et al. | 70/303 |
| 4,532,785 | 8/1985 | Uyeda | 70/333 |
| 4,541,259 | 9/1985 | Uyeda | 70/316 |
| 4,628,715 | 12/1986 | Uyeda et al. | 70/333 |
| 4,745,784 | 5/1988 | Gartner | 70/277 |
| 4,754,629 | 7/1988 | Allen | 70/333 R |
| 4,756,176 | 7/1988 | Uyeda | 70/303 A |
| 4,774,512 | 9/1988 | Jolidon et al. | 70/284 |
| 4,831,851 | 5/1989 | Larson | 70/303 |
| 4,904,984 | 2/1990 | Gartner et al. | 340/543 |
| 4,910,981 | 3/1990 | Gartner | 70/314 |
| 4,967,577 | 11/1990 | Gartner et al. | 70/303 A X |

FOREIGN PATENT DOCUMENTS

| | | | |
|---|---|---|---|
| 159448 | 1/1954 | Australia | 70/303 A |
| 0213237 | 3/1987 | European Pat. Off. | 70/455 |
| 3817696 | 11/1989 | Fed. Rep. of Germany | 70/277 |

*Primary Examiner*—Lloyd A. Gall

*Attorney, Agent, or Firm*—Poms, Smith, Lande & Rose

[57] ABSTRACT

An electronic combination lock is disclosed which allows access to a closed or secure location wherein the lock includes a locking mechanism for operating between a locked condition and an unlocked condition. A rotatable cam wheel has a circumferential surface portion defining a slot such that rotation of the cam wheel moves the slot. A moveable lever is coupled to the locking mechanism for changing the condition of the locking mechanism from the locked condition to the unlocked condition and is pivotably movable into and out of engagement with the cam wheel. The movable lever engages the cam wheel such that rotation of the cam wheel changes the condition of the locking mechanism. A cantilever and detent on the lever releasably maintain the lever in a position disengaged from the cam wheel. A solenoid and projectable detent moves the lever from its disengaged position for engaging the lever with the cam wheel so that rotation of the cam wheel changes the locking mechanism from the locked condition to the unlocked condition.

43 Claims, 4 Drawing Sheets

HIGH SECURITY ELECTRONIC DIAL COMBINATION LOCK

BACKGROUND OF THE INVENTION

1. Field of the Invention

This invention relates generally to electronic dial combination locks having improved tamper resistance, and more specifically to such locks wherein a locking mechanism is opened by rotation of the dial.

2. Description of the Related Art

Electronic dial combination locks allow authorized personnel to access otherwise inaccessible security regions such as safes, lock boxes, storage rooms and the like. One such class of lock is the electronic dial combination lock which uses a dial having divisions to enter a combination code to gain entrance to the secured area. The lock has a spindle journaled within the lock for both rotational and axial movement to cause a push pin located on an internal cam wheel to engage one of a plurality of pressure-sensitive switches within the lock located in an evenly-spaced circular pattern centered on the shaft's axis, each switch being capable of making a discrete, unique electrical connection. A circuit contained in the secured region senses the electrical connections and detects when a given subset of connections has been made corresponding to the lock's combination and initiates an electrical signal within the secured region. The signal may be used, e.g., to operate a solenoid to permit a conventional fence lever to engage the cam wheel such that a bolt within the lock may be withdrawn, such as in a safe door. Such a lock is shown and described in U.S. Pat. No. 4,745,784. In the lock of that patent, when the correct combination is entered, the solenoid releases a fence lever so that a nose part formed thereon falls by gravity onto the circumferential surface of a cam wheel. The cam wheel is rotated by the combination dial until the nose part on the fence lever engages the slot in the circumference of the cam wheel to allow withdrawal of the bolt in the locking mechanism.

It has been recognized heretofore that it would be desirable to have a positive drive of the fence toward the tumbler wheel gates and the lever nose toward its cam wheel slot to ensure operation of the lever on entry of the combination. Generally these locks have employed a cam mechanism operated off of dial rotation to drive its fence lever toward the wheel once on each rotation of the dial. Such a lock is illustrated in U.S. Pat. No. 4,910,981. However, there is the possibility of learning something about the lock's internal parts from such regular impacting of the wheel by its fence or unauthorized manipulation of the lock by lock experts.

There is thus a need for a dial combination lock which does not allow an unauthorized user to obtain information about the characteristics of the gate tumbler wheels or the slotted cam wheel through manipulation of the combination dial and fence lever. Additionally, there is a need for a combination lock which prevents engagement of the fence lever with the tumbler wheels or the cam wheel until such time as the correct combination has been dialed into the lock mechanism and the nose part on the lever is aligned with the slot on the cam wheel. There is also a need for a combination lock which provides for positive movement of the lever into engagement with the slot in the cam wheel upon alignment through rotation of the combination dial.

SUMMARY OF THE INVENTION

The present invention provides a high security electronic dial combination lock which provides improved means for minimizing tampering, and for providing more predictable operation of the lock by positively engaging the fence lever with the cam wheel when the nose part on the fence lever and the slot in the cam wheel are properly aligned.

These and other objects of the present invention are accomplished preferably in an electronic combination lock which allows access to a closed or secure location wherein the lock includes a locking mechanism for operating between a locked condition and an unlocked condition. A rotatable cam wheel has a circumferential surface portion defining a slot such that rotation of the cam wheel moves the slot. A movable lever is coupled to the locking mechanism for changing the condition of the locking mechanism from the locked condition to the unlocked condition and is pivotably movable into and out of engagement with the cam wheel. The movable lever engages the cam wheel such that rotation of the cam wheel changes the condition of the locking mechanism. Means are included for releasably maintaining the pivotable lever in a position substantially disengaged from the cam wheel. Means are also included for moving the lever from its disengaged position for engaging the lever with the cam wheel so that rotation of the cam wheel changes the locking mechanism from the locked condition to the unlocked condition.

With the lock described herein, the lever is maintained in the disengaged position until the proper code is received by the lock. This serves the distinct purposes of ensuring that the lever does not engage the cam wheel until such time as the proper code has been entered and also that the lever is properly aligned with the cam wheel to allow proper engagement therebetween. Therefore, contact between the lever and the cam wheel cannot be used to obtain information about the characteristics of the cam wheel simply by rotating the combination dial. The means for moving the lever from its disengaged position to engage the cam wheel provides positive movement of the lever for engaging the cam wheel so that engagement between the fence lever and the cam wheel is not dependent on the force of gravity.

In a preferred embodiment, a solenoid is activated upon entry of the proper combination code for moving a detent into position to be contacted by a boss on the cam wheel. Upon contact with the detent, further rotation of the cam wheel moves the entire solenoid housing which in turn moves a cantilevered portion of the lever so that a nose part on the lever properly engages the slot on the cam wheel. The combination of the boss on the cam wheel, the configuration of the solenoid housing and the cantilevered portion of the lever are such that the slot in the cam wheel and the nose part on the lever are properly aligned when the lever is moved into contact with the cam wheel.

A relock may be included to hold the lever in its disengaged position even after the solenoid or other parts of the lock are disabled or otherwise affected such as by tampering. In such a case, the locking mechanism thereafter cannot be moved into the unlocked condition.

Skilled practitioners will obtain a more complete understanding of the present invention from a review of the following detailed description of a preferred embodiment, in conjunction with the drawings, of which the following is a brief description.

DETAILED DESCRIPTION OF THE PREFERRED EMBODIMENT

Figure 1:
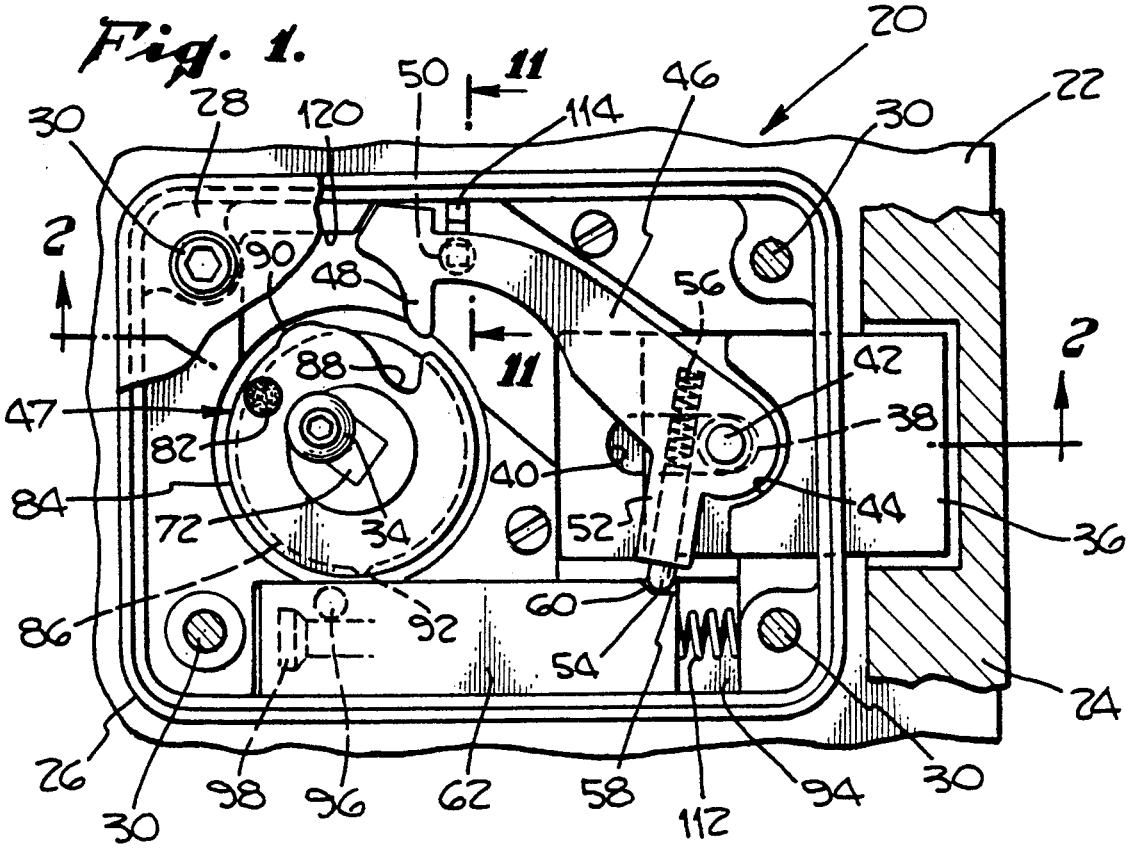
FIG. 1 is a rear partial sectional view of the lock according to the preferred embodiment of the present invention mounted to a frame element and showing a locking mechanism in a locked condition.

An exemplary embodiment of the preferred electronic dial combination lock 20 (FIGS. 1 and 2) in accordance with the present invention provides a high security lock which minimizes successful tampering, and provides positive engagement of a lever with a cam wheel when a protrusion on the lever is properly aligned with a slot on the cam wheel. The lock is preferably mounted on the inside surface of a door 22 or other frame element defining in part the closed or secured location protecting the secured area, such as the contents of a safe. The lock 20 keeps the door closed and locked against a frame element 24, which may be, for example, a safe enclosure.

The lock 20 is contained substantially within a housing 26 mounted on the rear or inside surface of the door 22 by conventional fastening means, such as screws and bosses. A cover plate 28 closes the lock housing and is mounted thereto through bolts 30 in a conventional manner. The cover plate includes an aperture 32 permitting access to a bolt 34.

Figure 2:
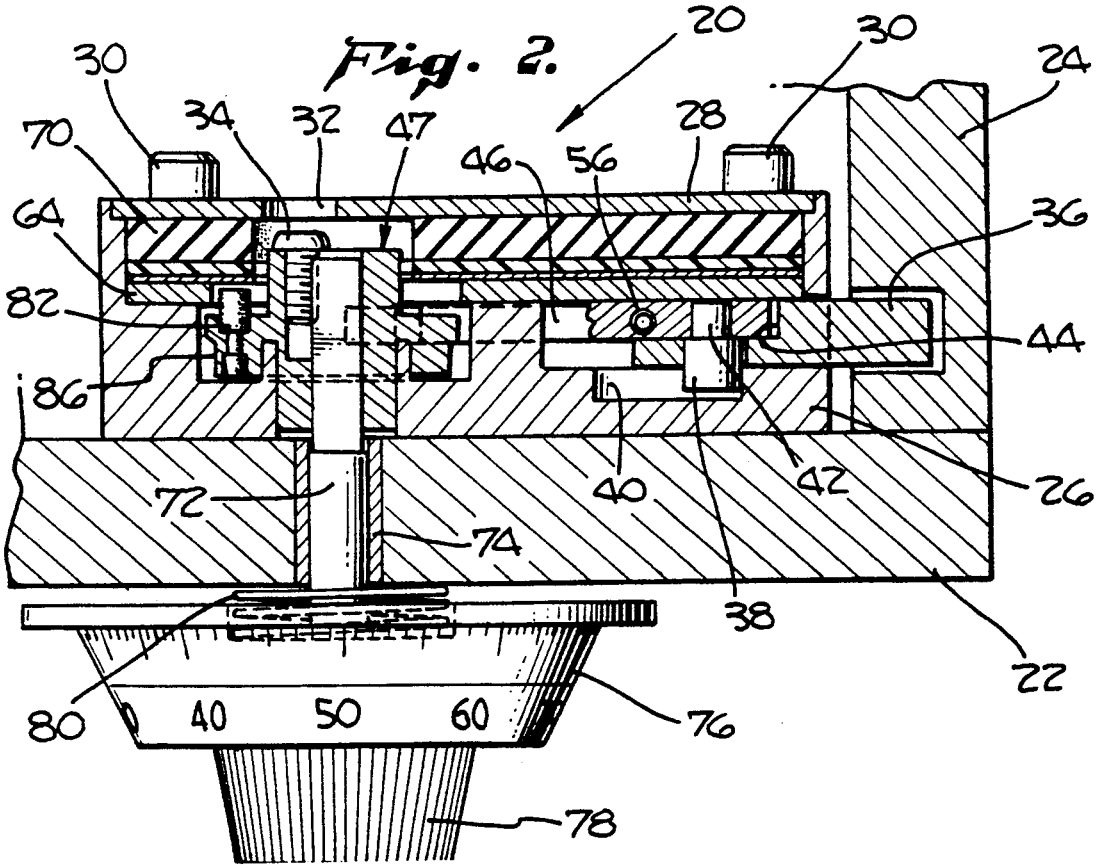
FIG. 2 is a bottom sectional view of the lock and frame element taken along the section line 2—2 shown in FIG. 1.
Figure 4:
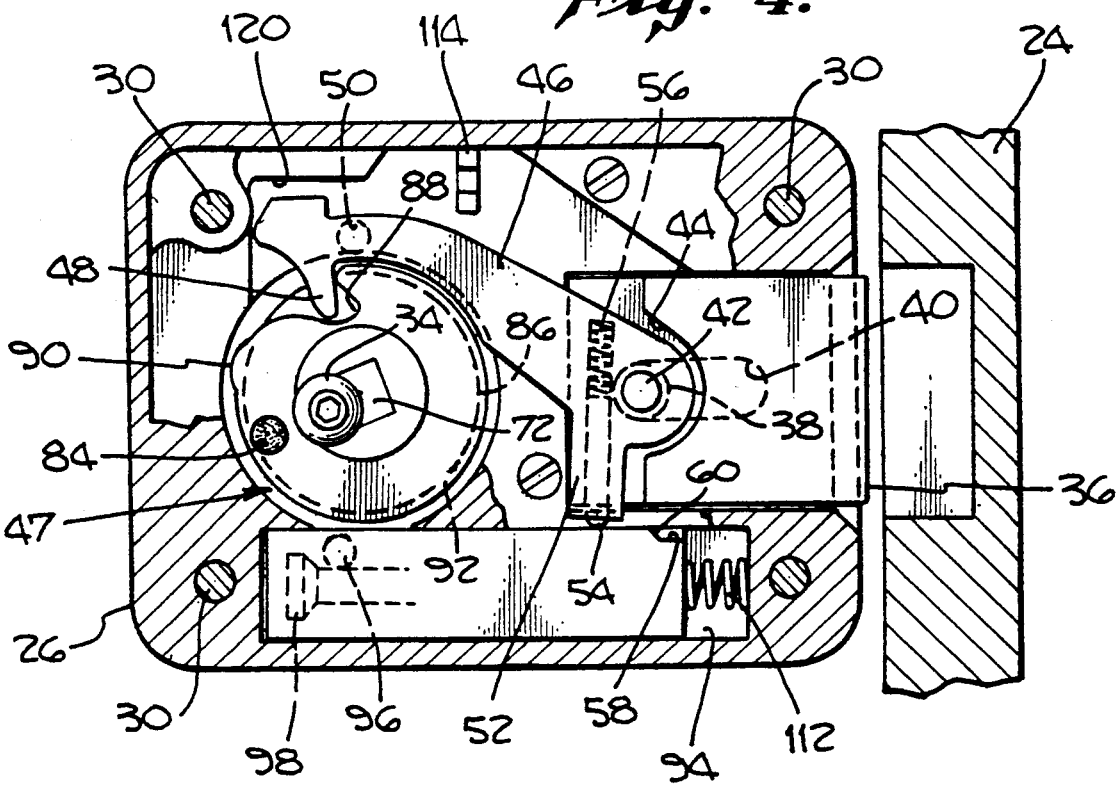
FIG. 4 is a rear sectional view of the lock of FIG. 1 showing a cam wheel rotated to longitudinally displace the lever and retract the bolt.

A locking mechanism in the form of a bolt 36 is slidably retained in the housing 26 to slide between a locked condition or position shown in FIGS. 1 and 2 and an unlocked condition or position (FIG. 4). The bolt slides in an opening in the side of the housing 26 into and out of a receptacle in the frame element 24. A pin 38 journaled through a portion of the bolt, interior to the housing 26, moves in a short track defined by a groove 40 formed in the base of the housing to limit the travel of the bolt between the locked position and the unlocked position. The pin has a reduced diameter portion 42 which extends to the side of the bolt opposite the groove 40 and into a milled out area 44 of the bolt.

Figure 11:
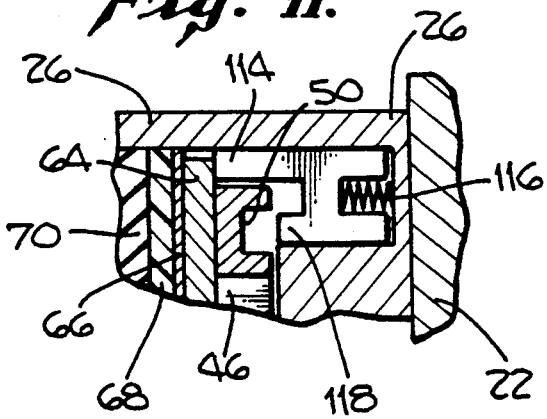
FIG. 11 is a detailed side section of a portion of the lock of FIG. 1 taken along the section line 11—11 showing a relock mechanism.
Figure 12:
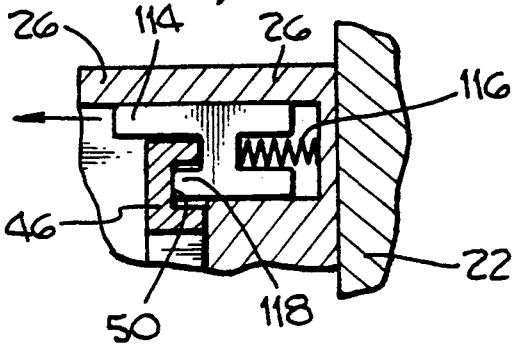
FIG. 12 is a side section similar to FIG. 11 showing the relock engaging the fence lever.

A lever 46 is pivotably coupled to the bolt through the reduced diameter portion 42 of the pin 38 for controlling the movement of the bolt 36 from the locked position to the unlocked position. Longitudinal movement of the lever within the housing moves the bolt, while rotational movement allows the lever to engage a cam wheel 47, as described more fully below. The lever extends from the pivot point at the pin 38 along a neck portion within the lock housing to a protrusion or nose part 48 for engaging the cam wheel 47. The neck of the lever between the nose part and the pivot point includes a relock recess 50 formed in that side of the lever which is adjacent the housing, i.e., closest to the door 22, for receiving the pin of a relock mechanism (described more fully below in conjunction with FIGS. 11 and 12).

The lever 46 includes a projection or blocking element in the form of a cantilever arm 52 for retaining or holding the lever 46 stationary and out of engagement with the cam wheel 47 when the cantilever arm is stationary and for pivoting the lever arm about the pivot point whenever the end of the cantilever arm is moved. The cantilever arm preferably extends from a portion of the lever close to the pivot point between the pivot point and the nose part 48. The cantilever arm includes a bore containing a detent pin 54 biased outwardly of the bore by a spring 56 so that the detent pin engages a recess 58 to block movement of the lever 46. The recess has a ramp surface 60 and is formed, in the preferred embodiment, integral with one end of a solenoid housing 62 (described more fully below). When the recess 58 is maintained in the position shown in FIG. 1, the lever is maintained in a position disengaged from the cam wheel for any rotational position of the cam wheel. Therefore, rotation of the cam wheel while the lever is in the disengaged position will not reveal any information about the configuration of the cam wheel or about the lever position. It should be noted that the recess 58 need not be integral with the solenoid housing but may be formed in a separate movable element which, when stationary, will maintain the lever 46 in a disengaged position from the cam wheel 47 for any rotational position of the cam wheel. As can be seen in FIG. 1, the relative angular position of the cantilever arm is preferably less than 180° but more than 90° from the neck portion of the lever.

The bolt 36 and the lever 46 are sandwiched between the housing 26 and a metal retaining plate 64. An opening in the metal plate accommodates rotation of the cam wheel 47, including the rubber finger used for entering the key code combination. A fish paper gasket 66 overlays the metal retaining plate and is coextensive with a printed circuit board 68 so that an appropriate combination code can be entered and received by the printed circuit board and processed in a manner such as that described in U.S. Pat. No. 4,745,784. The circuits on the printed circuit board are powered by a suitable power source (not shown), such as a replaceable battery as is well known to one skilled in the art. The printed circuit board is held in place by a rubber gasket 70 covered by the cover plate 28. Holes are formed in the fish paper gasket 66, the printed circuit board 68 and the rubber gasket 70 to allow free rotation of the cam wheel and the bolt 34.

A shaft or spindle 72 passes through the front of the housing 26 and through a sleeve 74 in the door 22 to extend outwardly of the secured area such that an external shaft end is accessible from outside the secured area while an internal end is within the lock housing. The shaft 72 is journaled within the housing for both rotational and axial movement relative to the housing and the printed circuit board 68. A dial 76 of well known configuration is mounted to the external end of the shaft and includes a knurled knob 78 for both rotating and axially moving the dial, and therefore the shaft. A spring 80 between the door 22 and a recess in the dial biases the dial and shaft outwardly relative to the lock housing 26.

The portion of the shaft 72 passing through the door 22 is round to permit smooth and reliable rotation of the dial and cam during manipulation of the dial. That portion of the shaft internal to housing 26 and extending a relatively short distance into the door 22 has preferably a square cross-section so that rotation of the shaft through the dial 76 rotates the cam wheel 47. The cam wheel 47 is mounted to the square portion of the shaft 72 for coaxial rotation and axial displacement of the cam wheel whenever the shaft is rotated or moved axially. The bolt 34 fixes the cam wheel on the shaft 72. A rubber combination finger 82 is fixed in the cam wheel at an angular position corresponding to one discreet dial and shaft position and at a given radial position relative to the axis of the shaft so as to allow entering of the combination code through appropriate rotation and axial movement of the cam wheel, as described more fully in U.S. Pat. No. 4,745,784.

The cam wheel 47 has two circumferential operating surfaces, located axially on the cam wheel adjacent one another. The rear-most operating surface of the cam wheel is located in the same plane as the nose part 48 of the lever 46 and will be termed the lever cam surface 84. The axially next adjacent cam surface will be termed the driving surface or solenoid cam surface 86 for moving the solenoid housing, as described more fully below. The lever cam surface 84 includes a gate or slot 88 to accept the nose part 48 of the lever such that upon rotation of the cam wheel by the dial 76 in the proper direction, the lever retracts the bolt 36 to unlock the lock. The lever cam surface also includes a slight outward bulge in the form of a lever lift cam 90 positioned, on the lever cam surface, counterclockwise from the slot 88, as viewed in FIG. 1 from the back of the lock, to insure that the nose part 48 of the lever is properly spaced from the cam wheel 47 when the locking mechanism is moved to the locked position.

The solenoid cam surface 86 is generally circular in outline having a normal diameter less than the normal diameter of the lever cam surface 84. The solenoid cam surface includes a small sloped protrusion or boss 92 extending radially outwardly of the solenoid cam surface and extending axially across substantially the entire solenoid cam surface 86 for engaging and pushing an extended detent in the solenoid housing 62 upon rotation of the cam wheel. The point of the boss 92 extends approximately to the same maximum radius as the maximum radius of the adjacent portion of the lever cam surface 84.

The solenoid housing 62 is a rigid body or element, preferably brass, movable in a channel 94 (FIGS. 3 and 4) for positively operating, driving or moving the lever from its disengaged position to a position for engaging the nose part 48 on the lever 46 with the slot 88 on the cam wheel 47 in response to dial 76 rotation after the combination code has been entered so that rotation of the cam wheel in a given direction changes the locking mechanism from the locked position (FIG. 3) to the unlocked position (FIG. 4).

Figure 5:
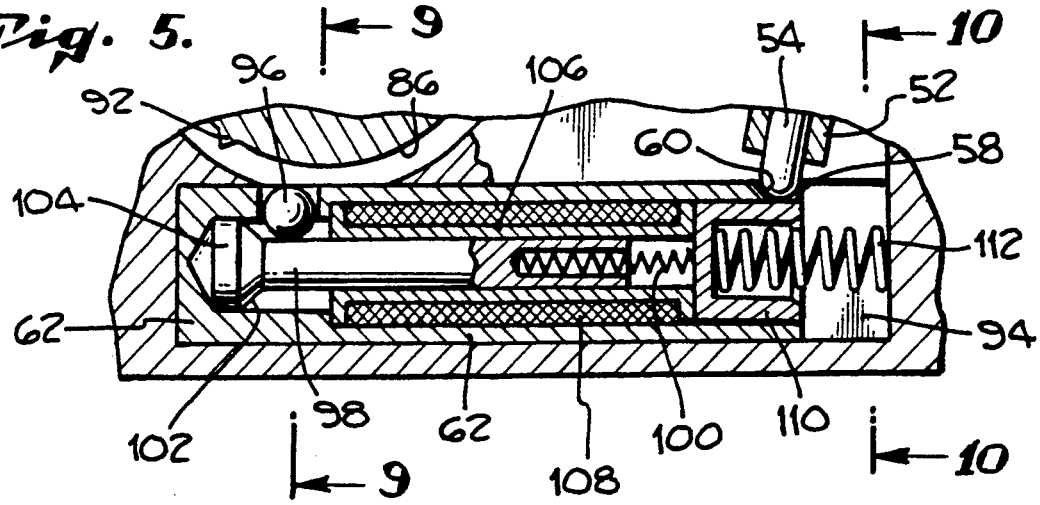
FIG. 5 is a detailed sectional view of a portion of the lock of FIG. 1 showing the elements of the solenoid in the de-energized configuration.
Figure 10:
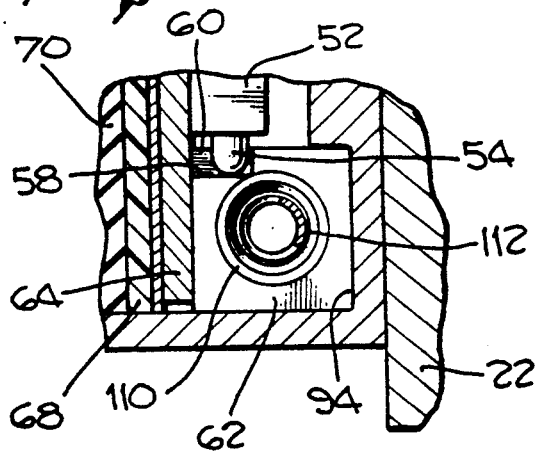
FIG. 10 is a side sectional view of a portion of the lock taken along the section line 10—10 of FIG. 5 showing the solenoid and a detent on the lever received in a recess.
Figure 9:
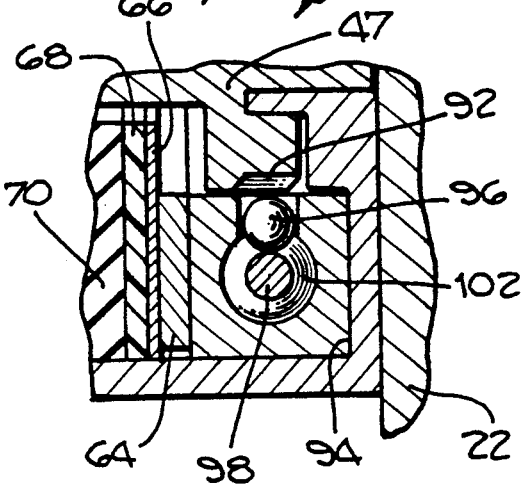
FIG. 9 is a side sectional view of a portion of the lock taken along the section line 9—9 of FIG. 5 showing the solenoid and a portion of the cam wheel.

Considering the solenoid in more detail (FIGS. 5–7, 9 and 10), the solenoid housing 62 is preferably substantially square in transverse outline (FIGS. 9 and 10) and is movable or slidable in the channel 94. The solenoid housing is closed at the left end and includes a circular hole opening at the top of the housing for holding and guiding a projectable element such as movable link element in the form of spherical or curved surface detent 96 which can project, extend or protrude outwardly of the solenoid housing to a detented or engagement position (FIGS. 6 and 7) upon actuation of the solenoid to allow the boss 92 to engage the extended detent and move the solenoid housing from left to right, as viewed in FIGS. 5–7. When the solenoid is not energized and the detent 96 is unextended or withdrawn, the detent 96 is supported below the opening by the shaft of a solenoid plunger 98. The plunger 98 is normally biased to the left (as viewed in FIG. 5) by a spring 100 biasing the plunger from the right end of the plunger. The unenergized configuration of the solenoid is shown in FIG. 5. The left end of the plunger includes a frustoconical section 102 having a sloped surface to allow the spherical detent 96, (upon actuation of the solenoid), to ride up the sloped surface and onto a cylindrical surface 104 at the end of the plunger so that the detent 96 protrudes from the solenoid housing and can then be engaged by the boss 92.

The shaft of the plunger is supported and guided by a spool 106, which in turn is supported by the walls of the solenoid housing. The spool supports a coil 108 which actuates the solenoid plunger when the correct combination code is entered into the printed circuit board and an appropriate signal is produced from an output on the printed circuit board to the coil 108 in the solenoid, as would be known to one skilled in the art. The electrical connection between the output from the printed circuit board and the solenoid coil is conventional and not shown.

An end cap or cup 110 closes the end of the solenoid housing to retain the plunger, spool and coil in place in the solenoid housing. The base of the cup contacting the flanges of the spool 106 supports the plunger spring 100 and stops the right-ward travel of the plunger when the solenoid is actuated. The cup includes an interior cavity opening to the right outside end of the solenoid housing for accepting a compression spring 112 for biasing the entire solenoid housing in a direction to the left as viewed in FIGS. 5–7 to position the lever out of engagement with the cam wheel.

A relock 114 (FIGS. 11 and 12) is mounted in and biased outwardly of a cavity in the lock housing 26. The relock is biased outwardly of the cavity by a relock spring 116 for relocking the lever 46 in the disengaged position (as viewed in FIG. 1) by means of a boss 118 on the relock entering the relock recess 50 in the neck of the lever 46. The relock is normally held in the retracted position by the metal retaining plate 64 when the retaining plate, fish paper gasket, printed circuit board, rubber gasket and the cover plate 28 are properly installed. The relock is pushed outwardly by the relock spring 116 to lock the lever in the disengaged position if the metal retaining plate 64 is ever moved, for example, by tampering with the shaft 72.

In operation, the bolt 36 is normally in the locked position, the solenoid is de-energized and the dial, shaft and cam wheel are freely rotatable and axially movable. The cam wheel does not engage significantly either the lever 46 or the solenoid housing 62, and the lever 46 is maintained in a position substantially disengaged from the cam wheel regardless of the rotational position of the cam wheel. The solenoid housing 62 is at its left-most position, and the pin 54 of the lever arm engages the recess 58. The solenoid plunger 98 is also in its left-most position, the solenoid being unenergized, and the detent 96 rests on the plunger shaft below the top edge of the solenoid housing.

By manipulation of the dial 76, the correct combination code can be entered by rotating the cam wheel and moving the cam wheel axially in the proper sequence so that the appropriate pressure pads on the printed circuit board 68 can be actuated by application of pressure through the combination finger 82, as would be understood by one skilled in the art.

Figure 6:
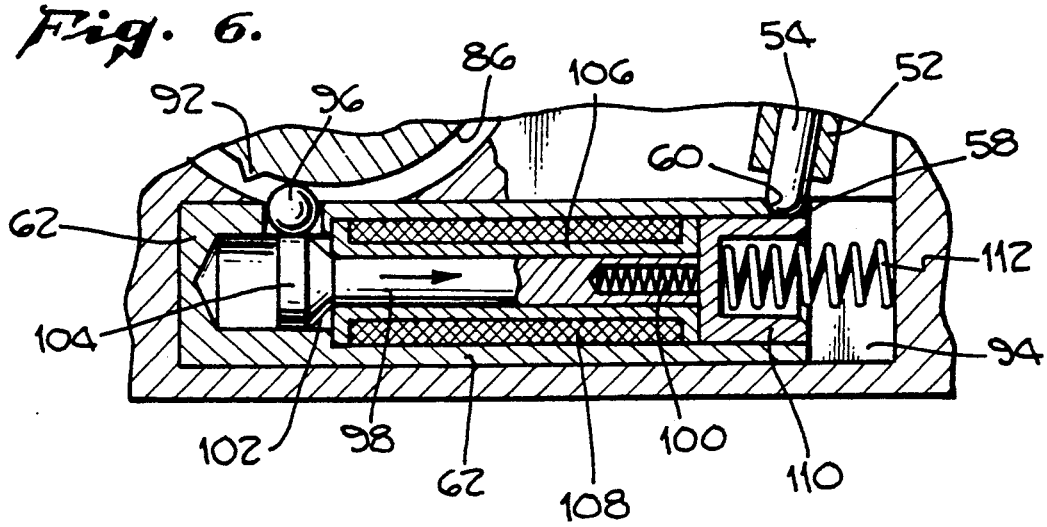
FIG. 6 is a detailed sectional view similar to FIG. 5 of a portion of the lock showing the solenoid energized.
Figure 7:
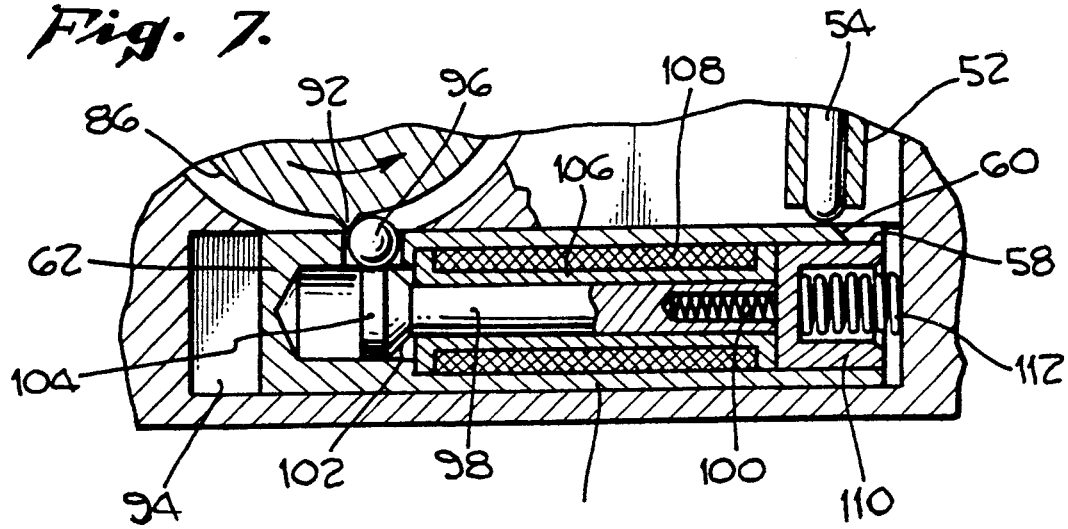
FIG. 7 is a detailed sectional view similar to FIG. 5 of a portion of the lock showing the solenoid energized and shifted to position the lever.
Figure 8:
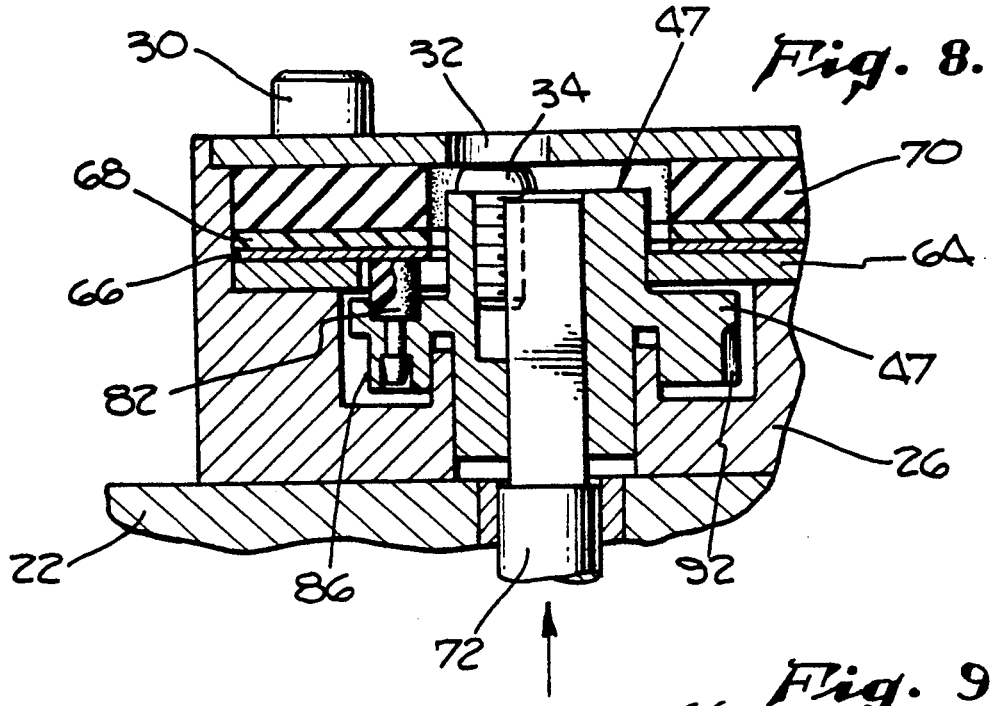
FIG. 8 is a rear sectional view of a portion of the lock showing one of the steps in the entry of a combination code.

Upon entry of the proper code, a suitable signal is produced at the output of the printed circuit board to the solenoid to actuate and move the plunger 98 to its right-most position. As the solenoid is actuated, the plunger moves to the right under control of the coil 108 so that the spherical detent 96 rides up the frustoconical section 102 and onto the cylindrical portion 104 of the plunger. The spherical detent is then exposed above the top of the solenoid housing 62 so that it can be engaged by the boss 92 on the solenoid cam surface 86 of the cam wheel 47. The condition of the solenoid in the actuated state is shown in FIG. 6. At that point, the cam wheel may be in any rotational position, and the lever is still maintained in its disengaged position. The solenoid housing is also still in its left-most position in the channel 94.

After the solenoid is actuated, the dial can be turned clockwise (counterclockwise as viewed from the back of the lock housing) until the boss 92 engages the spherical detent 96. As the cam wheel continues to rotate, the boss 92 pushes the spherical detent 96 and therefore the solenoid housing along the channel 94 against the bias of spring 112. Movement of the solenoid housing also moves the recess 58 which holds the detent pin 54. The initial movement of the solenoid housing causes the pin 54 in the cantilever arm 52 to move so that the lever pivots until the nose part 48 engages the slot 88 on the cam wheel. The boss 92 on the solenoid cam surface 86 and the slot 88 on the lever cam surface 84 are positioned angularly relative to each other such that the nose part of the lever and the slot 88 are aligned for engagement as the boss 92 pushes the spherical detent 96. After the nose part 48 engages the slot 88, continued translation of the solenoid housing in the channel 94 causes the pin 54 in the cantilever arm 52 of the lever to ride up the ramp surface 60 and onto the outside of the solenoid housing so that the pin can freely move along the solenoid housing as the bolt is retracted by further rotation of the cam wheel.

Figure 3:
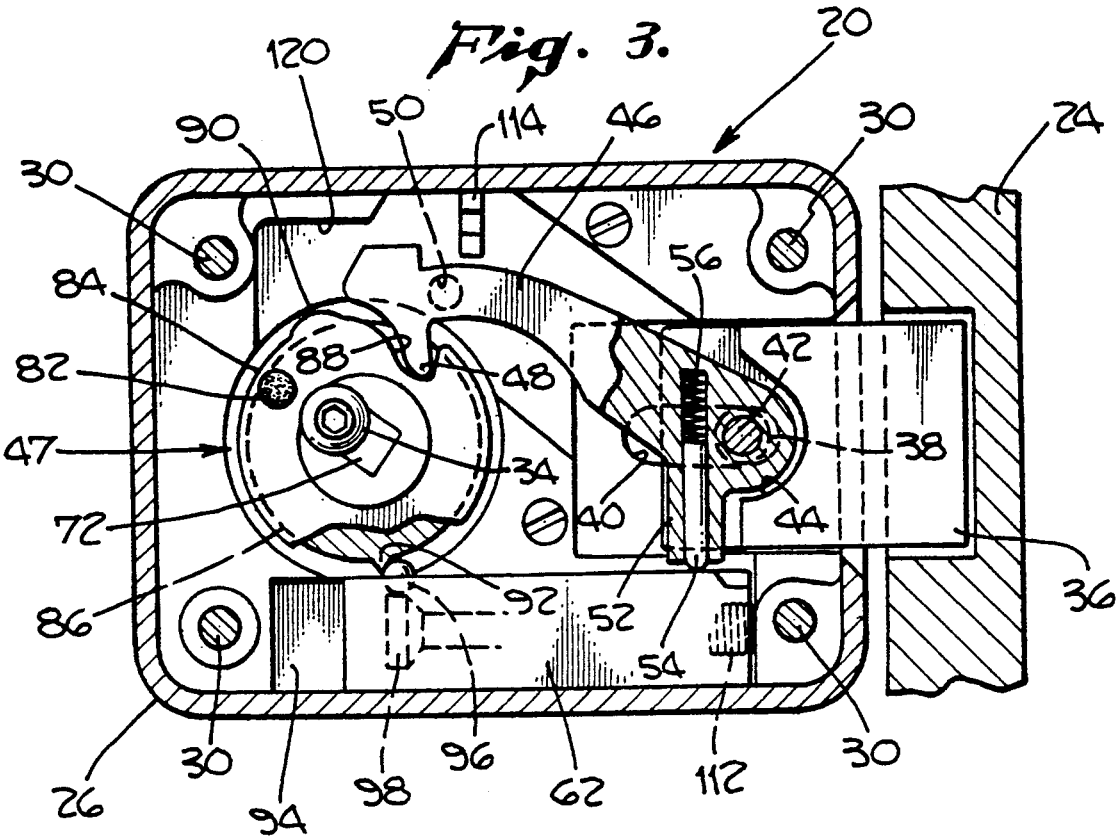
FIG. 3 is a rear sectional view of the lock of FIG. 1 showing activation and the shifted position of a solenoid to engage a lever with a cam wheel slot.

The position of the pin 54 relative to the ramp 60 when the solenoid housing has reached the right-most extent of its travel in the channel 94 is shown in FIG. 3. The lever 46 has fully engaged the gate in the cam wheel 47 such that further rotation of the cam wheel moves the lever longitudinally and so that the bolt 36 can be moved from the locked position shown in FIG. 3 to the unlocked position shown in FIG. 4. Simultaneously, the pin 54 can slide relative to the solenoid housing both as the bolt moves from the locked to the unlocked position and as the solenoid housing returns to its left-most position in the channel 94 as the solenoid becomes de-energized. The door can then be opened.

When the door is thereafter closed and the lock is to be moved back to its locked condition, the dial can be turned in the opposition direction so that the gate pushes the nose part 48 back in the opposite direction to return the bolt to its locked position. Any tendency of the lever to disengage from the gate is prevented by a bearing surface 120 formed in the housing (FIG. 4).

As the cam wheel 47 continues to turn, the lever disengages from the gate and the lever lift cam 90 lifts the end of the lever into the recess in the housing between the bearing surface 120 and the relock 114 (FIG. 1), thereby properly positioning the lever in its disengaged position and the pin 54 in the recess 58. Once the lever 46 has been moved to its disengaged position, the lever lift cam 90 may still touch the nose part 48 of the lever 46 but this possible contact is not considered substantial.

Having described an exemplary embodiment of the electronic dial combination lock in accordance with the present invention, it should now be apparent to those skilled in the art that the invention achieves the various objectives and advantages initially disclosed herein. It should also be understood by those skilled in the art that various modifications, adaptations and alternative embodiments of the lock of the present invention may be made within the scope and spirit of the present invention, which is defined by the following claims.

We claim:

1. In an electronically operated lock having a bolt operating lever manipulated by engagement with a dial operated cam when a predetermined combination has been entered via said dial, the improvement comprising the provision of:

lever retaining means for normally holding said lever out of engagement with said cam during rotation of said dial until after said combination has been entered;

lever operating means for positively driving said lever toward said cam in response to continued dial rotation after said combination has been entered, whereby said lock is unlocked by rotation of said dial after entry of said combination and said lever is positively manipulated by dial rotation to engage said dial operated cam only after entry of said combination;

said lock includes a solenoid electronically actuated by entry of the predetermined combination and said lever retaining means includes a lever movement blocking element; and said lever operating means includes a detent operable by said solenoid to a detented position and associated with said blocking element and a detent engaging member on said cam whereby operation of said solenoid by entry of said combination moves said detent to said detented position wherein rotation of said dial operated cam drives said member against said detent to move said lever into engagement with said cam.

2. An electronic combination lock to allow selective access to a closed or secured location, the lock comprising:

a locking mechanism for operating between a locked condition and an unlocked condition;

a rotatable cam wheel having a surface portion defining a cam surface such that rotation of the cam wheel in a given direction moves the cam surface in an arc;

a movable lever coupled to the locking mechanism for changing the condition of the locking mechanism from the locked condition to the unlocked condition, pivotably movable into and out of engagement with the cam wheel, and including a protrusion for engaging said cam surface in the cam wheel such that when the protrusion engages the cam surface rotation of the cam wheel maintains engagement of the cam wheel with the lever and changes the condition of the locking mechanism;

releasable means for maintaining the movable lever in a substantially stationary position disengaged from the cam wheel and independent of rotational movement of the cam wheel;

a substantially non-resilient lever moving element for moving the lever from its disengaged position for engaging the protrusion of the lever with the cam surface on the cam wheel so that rotation of the cam wheel thereafter in the given direction changes the locking mechanism from the locked condition to the unlocked condition; and a housing containing the cam wheel and having a wall, a shaft journaled through the wall of the housing and into the cam wheel such that rotation of the shaft rotates the cam wheel, a dial mounted to the shaft for selecting a combination code, and electronic means for recording the combination code being entered in order to unlock the lock wherein the combination code is entered into said electronic means through a sequence of rotational and axial movements of the dial.

3. An electronic combination lock to allow selective access to a closed or secured location, the lock comprising:

a locking mechanism for operating between a locked condition and an unlocked condition;

a rotatable cam wheel having an outer surface portion defining a cam surface such that rotation of the cam wheel in a given direction moves the cam surface in an arc;

a movable lever coupled to the locking mechanism for changing the condition of the locking mechanism from the locked condition to the unlocked condition, pivotably movable into and out of engagement with the cam wheel, and including a protrusion for engaging said cam surface in the cam wheel such that when the protrusion engages the cam surface rotation of the cam wheel maintains engagement of the cam wheel with the lever and changes the condition of the locking mechanism;

releasable means for maintaining the movable lever in a substantially stationary position disengaged from the cam wheel and independent of rotational movement of the cam wheel; and a substantially non-resilient lever moving element for moving the lever from its disengaged position for engaging the protrusion of the lever with the cam surface on the cam wheel so that rotation of the cam wheel thereafter in the given direction changes the locking mechanism from the locked condition to the unlocked condition; and wherein the cam wheel further includes means for moving the lever moving element upon rotation of the cam wheel when the correct combination has been entered and said lever moving element is electronically activated to cooperate with said moving means when said combination has been entered.

4. The lock of claim 3 wherein the lever moving element includes a projectable bearing surface which protrudes from the lever moving element upon electronic activation of the lever moving element and wherein the means for moving the lever moving element includes a protrusion from a circumferential surface portion on the cam wheel for bearing against the bearing surface.

5. An electronic combination lock to allow selective access to a closed or secured location, the lock comprising:

a locking mechanism for operating between a locked condition and an unlocked condition;

a rotatable cam wheel having a surface portion defining a cam surface such that rotation of the cam wheel in a given direction moves the cam surface in an arc;

a movable lever coupled to the locking mechanism for changing the condition of the locking mechanism from the locked condition to the unlocked condition, pivotably movable into and out of engagement with the cam wheel, and including a protrusion for engaging in said cam surface in the cam wheel such that when the protrusion engages the cam surface rotation of the cam wheel maintains engagement of the cam wheel with the lever and changes the condition of the locking mechanism;

releasable means for maintaining the movable lever in a substantially stationary position disengaged from the cam wheel and independent of rotational movement of the cam wheel;

means for moving the lever from its disengaged position for engaging the protrusion of the lever with the cam surface on the cam wheel so that rotation of the cam wheel thereafter in the given direction changes the locking mechanism from the locked condition to the unlocked condition;

wherein the releasable means for maintaining the movable lever includes a movable recessed surface and an element extending from the lever to the movable recessed surface such that movement of the recessed surface moves the lever; and wherein the element includes a spring-biased pin extending from a cantilevered portion of the lever and the movable recessed surface defines a recess for accepting and retaining a head of the biased pin when the lever is maintained in the disengaged position.

6. The lock of claim 5 wherein the movable recessed surface further defines a ramp so that the head of the biased pin can travel along the ramp and out of the recess.

7. The lock of claim 6 wherein the lever moving means includes a projectable surface, wherein the cam wheel includes a protrusion for engaging the projectable surface and wherein the lever moving means further includes a second rigid element extending between the cam wheel and the movable surface for moving the movable surface when the cam wheel rotates and the cam wheel protrusion engages the projectable surface on the lever moving means.

8. An electronic combination lock to allow selective access to a closed or secured location, the lock comprising:

a locking mechanism for operating between a locked condition and an unlocked condition;

a rotatable cam wheel having a surface portion defining a cam surface such that rotation of the cam wheel in a given direction moves the cam surface in an arc;

a movable lever coupled to the locking mechanism for changing the condition of the locking mechanism from the locked condition to the unlocked condition, pivotably movable into and out of engagement with the cam wheel, and including a protrusion for engaging said cam surface in the cam wheel such that when the protrusion engages the cam surface rotation of the cam wheel maintains engagement of the cam wheel with the lever and changes the condition of the locking mechanism;

releasable means for maintaining the movable lever in a substantially stationary position disengaged from the cam wheel and independent of rotational movement of the cam wheel;

a substantially non-resilient lever moving element for moving the lever from its disengaged position for engaging the protrusion of the lever with the cam surface on the cam wheel so that rotation of the cam wheel thereafter in the given direction changes the locking mechanism from the locked condition to the unlocked condition; and wherein the lever moving element includes a solenoid and a detent activated by the solenoid to protrude from the lever moving element upon electronic activation of the solenoid and further comprising means for moving the lever moving element including a protrusion from a circumferential surface portion on the cam wheel for bearing against the detent.

9. The lock of claim 8 wherein the lever moving element further includes a solenoid assembly having a solenoid housing enclosing a plunger normally biased such that the solenoid detent is recessed and wherein activation of the solenoid causes the solenoid detent to protrude from the housing.

10. The lock of claim 9 wherein the means for releasably maintaining the movable lever includes a spring-biased detent extending from the lever to engage a recessed ramp surface integral with the solenoid housing such that the spring-biased detent is held in the recess and the lever is disengaged from the cam wheel when the solenoid is unactivated.

11. The lock of claim 10 further comprising a lock housing containing the cam wheel and the solenoid assembly and wherein the solenoid housing extends between the solenoid detent and the ramp surface, wherein the solenoid housing includes a spring for biasing the solenoid housing such that the spring-biased detent rests in the recess when the lock combination has not been entered and wherein activation of the solenoid and rotation of the cam wheel moves the solenoid housing so that the lever is moved into engagement with the cam wheel and the spring-biased detent moves along the ramp and out of the recess.

12. An electronic combination lock to allow selective access to a closed or secured location, the lock comprising:

a locking mechanism for operating between a locked condition and an unlocked condition;

a rotatable cam wheel having a cam surface such that rotation of the cam wheel in a given direction moves the cam surface in an arc;

a movable lever coupled to the locking mechanism for changing the condition of the locking mechanism from the locked condition to the unlocked condition, pivotably movable into and out of engagement with the cam wheel, and including a protrusion for engaging the cam surface in the cam wheel such that when the protrusion engages the cam surface rotation of the cam wheel maintains engagement of the cam wheel with the lever which changes the condition of the locking mechanism;

a lever controlling element for maintaining the movable lever in a substantially stationary position disengaged from the cam wheel and independent of any rotational movement of the cam wheel and for moving the lever from its disengaged position to a position for engaging the protrusion on the lever with the cam surface on the cam wheel so that thereafter rotation of the cam wheel in the given direction changes the locking mechanism from the locked condition to the unlocked condition;

wherein the locking mechanism includes a bolt, the protrusion is defined by a nose part, the cam surface in the rotatable cam wheel is configured for accepting the nose part on the movable lever and wherein the movable lever is pivotably coupled to the bolt through a pin; and wherein the lever controlling element includes a cantilever portion extending from the lever having a spring-biased detent for engaging a recess to maintain the pivotable lever in a disengaged position.

13. The lock of claim 12 wherein the lever controlling element includes an element extending between the cam wheel and the recess for the spring-biased detent such that movement of the element moves the pivotable lever into engagement with the cam wheel.

14. The lock as claimed in claim 13 wherein the lever controlling element further includes a solenoid actuated detent for engagement with a protruding circumferential surface portion on the cam wheel so that rotation of the cam wheel with engagement of the protruding circumferential surface portion with the detent moves the lever into engagement with the cam surface on the cam wheel.

15. The lock of claim 14 wherein the recess includes a surface defining a ramp to allow the spring-biased detent to travel up the ramp and out of the recess.

16. An electronic combination lock to allow selective access to a closed or secured location, the lock comprising:

a locking bolt for operating between a locked condition and an unlocked condition;

a rotatable cam wheel having a circumferential surface portion defining a slot such that rotation of the cam wheel in a given direction moves the slot in an arc;

a movable lever pivotably coupled to the locking bolt for changing the condition of the locking bolt between the locked and unlocked condition, pivotably movable into and out of engagement with the slot in the cam wheel, including a cantilevered portion and further including a nose part for engaging the slot in the cam wheel such that when the nose part engages the slot, rotation of the cam wheel changes the condition of the locking bolt;

a spring-biased detent extending from and biased outwardly of the cantilevered portion of the lever for maintaining the pivotable lever in a substantially stationary position disengaged from the cam wheel independent of any rotational movement of the cam wheel; and a solenoid including a solenoid housing having a recess on an outside surface thereof for accepting the spring-biased detent on the lever and containing an electrically actuatable solenoid plunger which upon actuation causes a detent ball to project from an opening in the surface of the solenoid housing and wherein the solenoid housing is movable from a first position to a second position to move the nose part of the lever into engagement with the cam wheel slot.

17. In an electronically operated lock having a bolt operating lever manipulated by engagement with a dial operated cam when a predetermined combination has been entered via said dial, the improvement comprising the provision of:

lever retaining means for normally holding said lever out of engagement with said cam during rotation of said dial until after said combination has been entered;

lever operating means including a rigid element separate from the lever and out of contact with the cam before entry of said combination for positively driving said lever toward said cam in response to continued dial rotation after said combination has been entered, whereby said lock is unlocked by rotation of said dial after entry of said combination and said lever is positively manipulated through the rigid element by dial rotation to engage said dial operated cam only after entry of said combination;

wherein the cam includes a protruding circumferential surface portion, wherein the rigid element separate from the lever includes a shaft having a first end adjacent the cam such that the protruding circumferential surface portion passes adjacent the first end upon rotation of the cam and a second end adjacent the lever such that, upon entry of said combination, the protruding circumferential surface portion moves the first end of the shaft to move the shaft and the lever to engage the dial operated cam only after entry of the combination; and wherein the lever retaining means includes a cantilever portion extending from the lever having a spring-biased detent for engaging a recess in the shaft to maintain the lever in a disengaged position.

18. The lock of claim 17 wherein the recess includes a surface defining a ramp to allow the spring-biased detent to travel up the ramp and out of the recess.

19. In an electronically operated lock having a bolt operating lever manipulated by engagement with a dial operated cam when a predetermined combination has been entered via said dial, the improvement comprising the provision of:

lever retaining means for normally holding said lever out of engagement with said cam during rotation of said dial until after said combination has been entered;

lever operating means including a rigid element separate from the lever and out of contact with the cam before entry of said combination for positively driving said lever toward said cam in response to continued dial rotation after said combination has been entered, whereby said lock is unlocked by rotation of said dial after entry of said combination and said lever is positively manipulated through the rigid element by dial rotation to engage said dial operated cam only after entry of said combination;

wherein the cam includes a protruding circumferential surface portion, wherein the rigid element separate from the lever includes a shaft having a first end adjacent the cam such that the protruding circumferential surface portion passes adjacent the first end upon rotation of the cam and a second end adjacent the lever such that, upon entry of said combination, the protruding circumferential surface portion moves the first end of the shaft to move the shaft and the lever to engage the dial operated cam only after entry of the combination;

wherein the cam further includes a cam slot and the shaft further includes a solenoid actuated detent for engagement with the protruding circumferential surface portion on the cam so that rotation of the cam with engagement of the protruding circumferential surface portion with the detent moves the lever into engagement with the cam slot on the cam.

20. An electronic combination lock to allow selective access to a closed or secured location, the lock comprising:

a locking mechanism for operating between a locked condition and an unlocked condition;

a rotatable cam wheel having a surface portion defining a cam surface such that rotation of the cam wheel in a given direction moves the cam surface in an arc;

a movable lever coupled to the locking mechanism for changing the condition of the locking mechanism from the locked condition to the unlocked condition, pivotably movable into and out of engagement with the cam wheel, and including a protrusion for engaging said cam surface in the cam wheel such that when the protrusion engages the cam surface rotation of the cam wheel maintains engagement of the cam wheel with the lever and changes the condition of the locking mechanism;

releasable means for maintaining the movable lever in a substantially stationary position disengaged from the cam wheel and independent of rotational movement of the cam wheel;

a substantially non-resilient lever moving element for moving the lever from its disengaged position for engaging the protrusion of the lever with the cam surface on the cam wheel so that rotation of the cam wheel thereafter in the given direction changes the locking mechanism from the locked condition to the unlocked condition; and wherein the lever moving element includes a projectable element out of contact with the cam wheel before entry of a combination to open the lock and projectable toward the cam wheel so that rotation of the cam wheel contacts the projectable element to move the lever for engaging the protrusion on the lever with the cam surface on the cam wheel.

21. The lock of claim 20 wherein the projectable element includes a detent.

22. The lock of claim 20 further comprising an electromechanical device for projecting the projectable element toward the cam wheel after entry of the combination.

23. The lock of claim 22 wherein the electromechanical device includes a solenoid actuated after entry of the combination.

24. An electronic combination lock to allow selective access to a closed or secured location, the lock comprising:

a locking mechanism for operating between a locked condition and an unlocked condition;

a rotatable cam wheel having a surface portion defining a cam surface such that rotation of the cam wheel in a given direction moves the cam surface in an arc;

a movable lever coupled to the locking mechanism for changing the condition of the locking mechanism from the locked condition to the unlocked condition, pivotably movable into and out of engagement with the cam wheel, and including a protrusion for engaging said cam surface in the cam wheel such that when the protrusion engages the cam surface rotation of the cam wheel maintains engagement of the cam wheel with the lever and changes the condition of the locking mechanism;

releasable means for maintaining the movable lever in a substantially stationary position disengaged from the cam wheel and independent of rotational movement of the cam wheel;

a substantially non-resilient lever moving element for moving the lever from its disengaged position for engaging the protrusion of the lever with the cam surface on the cam wheel so that rotation of the cam wheel thereafter in the given direction changes the locking mechanism from the locked condition to the unlocked condition;

wherein the releasable means includes a projection on the movable lever for engaging the lever moving element such that movement of the lever moving element moves the projection on the lever to move the lever; and wherein the projection on the movable lever includes an outwardly biased pin to contact the lever moving element.

25. An electronic combination lock to allow selective access to a closed or secured location, the lock comprising:

a locking mechanism for operating between a locked condition and an unlocked condition;

a rotatable cam wheel having a cam surface such that rotation of the cam wheel in a given direction moves the cam surface in an arc;

a movable lever coupled to the locking mechanism for changing the condition of the locking mechanism from the locked condition to the unlocked condition, pivotably movable into and out of engagement with the cam wheel, and including a protrusion for engaging said cam surface in the cam wheel such that when the protrusion engages the cam surface rotation of the cam wheel maintains engagement of the cam wheel with the lever which changes the condition of the locking mechanism;

a lever controlling element for maintaining the movable lever in a substantially stationary position disengaged from the cam wheel and independent of any rotational movement of the cam wheel and for moving the lever from its disengaged position to a position for engaging the protrusion on the lever with the cam surface on the cam wheel so that thereafter rotation of the cam wheel in the given direction changes the locking mechanism from the locked condition to the unlocked condition; and wherein the lever controlling element includes a projectable element out of contact with the cam wheel before entry of a combination to open the lock and projectable toward the cam wheel so that rotation of the cam wheel contacts the projectable element to move the lever for engaging the protrusion on the lever with the cam surface on the cam wheel.

26. The lock of claim 25 further comprising an electromechanical device for projecting the projectable element toward the cam wheel after entry of the combination.

27. The lock of claim 26 wherein the electromechanical device includes a solenoid actuated after entry of the combination.

28. In an electronically operated lock having a bolt operating lever manipulated by engagement with a dial operated cam when a predetermined combination has been entered via said dial, the improvement comprising the provision of:

lever retaining means for normally holding said lever out of engagement with said cam during rotation of said dial until after said combination has been entered;

lever operating means including a rigid element separate from the lever and out of contact with the cam before entry of said combination for positively driving said lever toward said cam in response to continued dial rotation after said combination has been entered, whereby said lock is unlocked by rotation of said dial after entry of said combination and said lever is positively manipulated through the rigid element by dial rotation to engage said dial operated cam only after entry of said combination; and wherein the lever operating means includes a projectable element out of contact with the cam before entry of a combination to open the lock and projectable toward the cam so that rotation of the cam contacts the projectable element to move the lever for engaging the lever with the cam.

29. The lock of claim 28 further comprising an electromechanical device for projecting the projectable element toward the cam after entry of the combination.

30. The lock of claim 29 wherein the electromechanical device includes a solenoid actuated after entry of the combination.

31. In an electronically operated lock having a bolt operating lever manipulated by engagement with a dial operated cam when a predetermined combination has been entered via said dial, the improvement comprising the provision of:

a retaining element for holding the lever out of engagement with said cam during rotation of said dial until after said combination has been entered;

a lever moving element separate from the lever for positively driving said lever toward said cam in response to continued dial rotation after said combination has been entered, whereby said lock is unlocked by rotation of said dial after entry of said combination and said lever is positively manipulated by dial rotation to engage said dial operated cam only after entry of said combination; and a movable link element movable from a withdrawn position spaced from the cam to an engagement position relative to the cam such that at least part of the cam engages the movable link element during at least part of the movement of the cam, wherein the movable link element is positioned substantially at the withdrawn position before entry of said combination and the movable link element is movable to the engagement position only after entry of said combination, and wherein the cam contacts and moves the movable link element only after entry of said combination, and movement of the link element by the cam causes the lever moving element to move the lever into engagement with the cam.

32. The lock of claim 31 wherein the lever moving element is rigid and wherein the lever moving element includes a spring for biasing the rigid lever moving element.

33. The lock of claim 31 further comprising an electromechanical device for moving the link element after entry of said combination.

34. An electronic combination lock to allow selective access to a closed or secured location, the lock comprising:

a locking mechanism for operating between a locked condition and an unlocked condition;

a cam having a cam surface for moving a lever and a driving surface at a location on the cam separate from the cam surface;

said movable lever coupled to the locking mechanism for changing the condition of the locking mechanism from the locked condition to the unlocked condition, pivotably movable into and out of engagement with the cam, and including a protrusion for engaging the cam surface on the cam such that when the protrusion engages the cam surface, movement of the cam maintains engagement of the cam with the lever which changes the condition of the locking mechanism;

a movable link member for holding the lever out of engagement with the cam surface before entry of a combination and for releasing the lever after entry of the combination;

a movable element normally positioned so as to be disengaged from the driving surface on the cam before entry of the combination and for projecting a sufficient distance relative to the driving surface on the cam to engage the driving surface on the cam after entry of the combination and so that movement of the driving surface on the cam moves the movable element which in turn causes the movable link member to be moved so as to release the lever, thereby permitting the lever to engage the cam surface so that movement of the cam surface moves the lever to change the locking mechanism to an unlocked condition.

35. The electronic combination lock of claim 34 wherein the movable projecting element is electrically operable to move to a position relative to the cam to be engagable with the driving surface.

36. The electronic combination lock of claim 35 wherein the electrically operable projecting element is a ball projectable by a solenoid after entry of the combination.

37. The electronic combination lock of claim 35 wherein the electrically operable projecting element is an element having a curved surface for engaging the driving surface after entry of the combination.

38. The electronic combination lock of claim 34 wherein the driving surface on the cam includes a tooth for engaging the movable projecting element after entry of the combination.

39. The electronic combination lock of claim 38 wherein the tooth is located on the cam at a predetermined location so as to engage the movable projecting element after the projecting element has moved toward the cam.

40. The electronic combination lock of claim 34 wherein the link member further includes a rigid element for transmitting movement of the projecting element, due to movement of the driving surface, to the movable link member to move the link member in order to permit release of the lever from the movable link member.

41. The electronic combination lock of claim 34 wherein the movable link member and the lever are releasably coupled through a combination of a pin and surface defining a recess wherein movement of the movable link member disengages the pin from the recess.

42. The electronic combination lock of claim 41 wherein the pin is coupled to the lever and the recess is defined by a surface on the movable link member.

43. An electronic combination lock to allow selective access to a closed or secured location and having a locking mechanism for operating between a locked condition and an unlocked condition and a manually operated dial and a dial shaft extending into the lock, the lock comprising:

a cam having a cam surface;

a manually operated driving surface driven through the dial shaft;

a movable lever coupled to the locking mechanism for changing the condition of the locking mechanism from the locked condition to the unlocked condition, pivotably movable into and out of engagement with the cam, and including a protrusion for engaging the cam surface on the cam such that when the protrusion engages the cam surface, movement of the cam maintains engagement of the cam with the lever which changes the condition of the locking mechanism;

a movable link member for holding the lever out of engagement with the cam surface before entry of a combination and for releasing the lever after entry of the combination;

a movable projecting element normally positioned so as to be disengaged from the driving surface before entry of the combination and for projecting a sufficient distance relative to the driving surface to engage the driving surface after entry of the combination and so that movement of the driving surface moves the projecting element which in turn causes the movable link member to be moved so as to release the lever, thereby permitting the lever to engage the cam surface so that movement of the cam surface moves the lever to change the locking mechanism to an unlocked condition.

* * * * *